US006342147B1

(12) United States Patent
Lowrie

(10) Patent No.: US 6,342,147 B1
(45) Date of Patent: Jan. 29, 2002

(54) PROCESS FOR PRODUCING HARD, ELECTRODEPOSITED IRON WITH INHERENT CHANNEL POROSITY

(76) Inventor: Charles F. Lowrie, 16092 Hwy. 205, Terrell, TX (US) 75160-0936

( * ) Notice: Subject to any disclaimer, the term of this patent is extended or adjusted under 35 U.S.C. 154(b) by 0 days.

(21) Appl. No.: 09/440,600

(22) Filed: Nov. 15, 1999

Related U.S. Application Data

(63) Continuation of application No. 09/031,217, filed on Feb. 26, 1998, now abandoned.

(51) Int. Cl.[7] ..... C25D 3/20

(52) U.S. Cl. ..... 205/270; 205/255; 205/112; 205/113

(58) Field of Search ..... 205/270, 255, 205/112, 113

(56) References Cited

U.S. PATENT DOCUMENTS

| | | | | |
|---|---|---|---|---|
| 2,523,160 | A | | 9/1950 | Struyk et al. |
| 2,918,415 | A | | 12/1959 | Schaer |
| 4,101,387 | A | | 7/1978 | Creutz et al. |
| 4,221,639 | A | | 9/1980 | Ninagawa et al. |
| 4,381,673 | A | * | 5/1983 | Klauba et al. ..... 73/579 |
| 4,382,673 | A | | 5/1983 | Klauba et al. |
| 4,666,567 | A | | 5/1987 | Loch |
| 4,869,971 | A | | 9/1989 | Nee et al. |
| 5,516,419 | A | | 5/1996 | Phan et al. |

OTHER PUBLICATIONS

Product Brochure—*Iron Plating, Metal Finishing Guidebook and Directory Issue*, vol. 93, No. 1A, pp. 255–258, 1995, reprinted in same publication in 1996, 1997, and 1998. No month available.

* cited by examiner

*Primary Examiner*—Kathryn Gorgos
*Assistant Examiner*—Wesley A. Nicolas
(74) *Attorney, Agent, or Firm*—Mark W. Handley

(57) ABSTRACT

A process of producing an iron plating on a metal surface of a part is provided. The process includes the steps of forming and maintaining an electrolytic plating bath to comprise: 200–500 Gm/L ferrous sulfate; 20–70 Gm/L ferrous fluoborate; 10–35 Gm/L ammonium chloride; and an effective amount of wetting agent in an aqueous solution; maintaining the pH of the bath in the range of 1.5 to 4.2; maintaining the temperature of the bath in the range of 100° F. to 160° F.; and maintaining the current density in the bath in the range of 2 to 60 amps/sq.ft. At least the metal surface of the part to be plated is contacted with the electrolytic plating bath. According to a further aspect of the invention, during electroplating, the pH, the temperature, and/or the current density are changed within their specified ranges to control the microstructure of the electrodeposited iron. An iron plating on a part can be produced wherein the iron plating has a surface network of channel type porosity wherein the channels are in the range of 0.0005 inch to less than 0.010 inch deep, and wherein the iron plating has a preplate strata having a hardness ranging from 35 to 55 Rc.

30 Claims, 1 Drawing Sheet

PROCESS FOR PRODUCING HARD, ELECTRODEPOSITED IRON WITH INHERENT CHANNEL POROSITY

This application is a continuation of U.S. application Ser. No. 09/031,217, filed Feb. 26, 1998, now abandoned, entitled "PROCESS FOR PRODUCING HARD, ELECTRODEPOSITED IRON WITH INHERENT CHANNEL-TYPE POROSITY."

TECHNICAL FIELD

The present invention provides a process for producing electrolytic, pure iron in an unprecedented state previously unexplored and/or utilized. Specifically, the process can produce an iron material that offers an alternative to industrial, hard, electrolytic chromium, as well as many other coating procedures.

BACKGROUND OF THE INVENTION

Many processes and variations of processes for the electrodeposition of hard iron are to be found in literature. Electrolytic hard iron has been produced and utilized for a number of years, but its use has usually been limited to applications where wear resulting from lack of lubrication was not a consideration, i.e., previous processes were able to produce hard iron that was dense with no or limited controlled lubrication. Previous procedures to induce oil containing reservoirs, which are desirable, if not necessary, in most applications, have been mechanical, laser, or electrochemical etch in nature.

SUMMARY OF THE INVENTION

According to the invention, a process of producing a new, hard, electrolytic iron plating is provided. The iron plating can be applied to a metal surface of virtually any type of part, for example, engine parts or soldering tips. After a part to be plated is prepared for plating, it is placed in an iron electroplating bath. An electrolytic plating bath from which a new, hard, electrolytic iron can be produced is maintained to be composed of the following:

200–500 Gm/L Ferrous Sulfate;

20–70 Gm/L Ferrous Fluoborate;

10–35 Gm/L Ammonium Chloride; and an effective amount of wetting agent in an aqueous solution, where Gm/L is units of grams per liter. Wetting agents are well known in the art, and new wetting agents are developed from time to time. For example, the wetting agent can be selected from the group consisting of sodium salts of the fatty alcohol sulfates or mixtures of such salts, equivalent surface active agents, or any combination thereof. For example, an effective amount of wetting agent is 0.2–0.8 Gm/L sodium lauryl sulfate.

The pH of the plating bath is maintained in the range of 1.5 to 4.2 and adjusted with sulfuric acid and/or fluoboric acid. The temperature of the bath is maintained in the range of 100° F. to 160° F. Current density is relatively low and maintained in the range of 2 to 60 amps/sq.ft.(A.S.M.)

According to one aspect of the invention, the pH is changed within the specified pH range during the electroplating to at least partially control the microstructure of the electrodeposited iron. For example, if the pH is stepped or ramped down, the microstructure of the electrodeposited iron tends to change from a relatively dense iron plating base to an increasingly porous and channeled iron plating producing a desirable surface with a microstructure having reservoirs and channels.

According to a second aspect of the invention, the temperature is changed within the specified temperature range during the electroplating to at least partially control the microstructure of the electrodeposited iron. For example, if the temperature is stepped or ramped down, the microstructure of the electrodeposited iron tends to change from a relatively dense iron plating base to an increasingly porous and channeled iron plating producing a desirable surface with a microstructure having reservoirs and channels.

According to a third aspect of the invention, the current density is changed within the specified range during the electroplating to at least partially control the microstructure of the electrodeposited iron. For example, if the current density is stepped or ramped up, the microstructure of the electrodeposited iron tends to change from a relatively dense iron plating base to an increasingly porous and channeled iron plating producing a desirable surface with a microstructure having reservoirs and channels. All current used throughout the process is D.C. in nature. The part is cathodic and an iron-based anode is used.

It has been discovered that using two or more of these inventive techniques together produces synergistic results. For example, changing the pH, temperature, and current density is especially useful in controlling the nature of the build of the iron deposit and the resulting microstructure of the iron plating.

Plating time is based on the current density and the desired thickness of the iron deposit.

It is to be understood that the steps of the process need not be performed in any particular order. These and other aspects of the invention will be apparent to a person of ordinary skill in the art upon reading the following detailed description of a presently preferred embodiment and best mode of practicing the invention.

BRIEF DESCRIPTION OF THE DRAWINGS

The accompanying drawing is incorporated into and forms a part of the specification to illustrate several examples of the present invention. The photomicrographs of the drawing together with the description serve to explain the principles of the invention. The drawing is only for the purpose of illustrating preferred and alternative examples of how the invention can be made and used and is not to be construed as limiting the invention to only the illustrated and described examples. The various advantages and features of the present invention will be apparent from a consideration of the drawing in which.

DETAILED DESCRIPTION OF A PRESENTLY MOST PREFERRED EMBODIMENT AND BEST MODE

Figure 1:
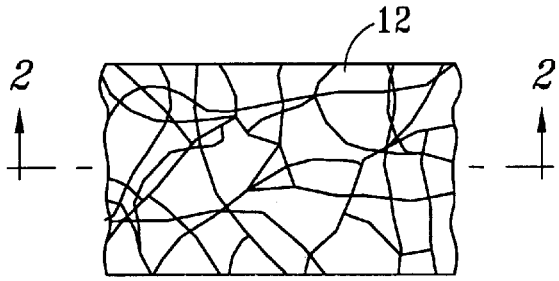
FIG. 1 illustrates a photomicrograph showing a typical porosity pattern of the new hard iron surface produced according to a preferred embodiment of the invention.

The present invention will be described by referring to examples of how the invention can be made and used. Most applications of the new product, such as mismachined, worn or new, compressor and power cylinders and other engine parts, etc., require precise restoration, dimensionally. Accordingly, usually a minimum of 0.014 inch thickness of basis metal is honed or ground from the part in preparation for electroplating. Additional metal may require removal to produce a surface comparable to that of the new part and/or acceptable for plating. An additional 0.0005 inch to 0.001 inch thickness of material is removed by superfinishing with an appropriate grade of sandpaper. Precise dimensions are monitored throughout the entire process.

Following machining, the part is fixtured for plating, degreased, and all areas not to be plated are coated with microcrystalline wax.

The part is anodically electrocleaned for 10 to 40 minutes in an alkaline solution of 10 to 30 Gm/L sodium hydroxide and 10 to 30 Gm/L sodium metasilicate maintained in the range of 120° F. to 160° F. More preferably, the part is anodically electrocleaned for about 20 minutes in an alkaline solution of 15 to 25 Gm/L sodium hydroxide and 15 to 25 Gm/L sodium metasilicate maintained in the range of about 140° F. Current density for this electrocleaning step is 50 to 150 amps/sq.ft., and, more preferably, is about 100 amps/sq.ft.

After thoroughly rinsing with water, the part is placed in a cold water bath and allowed to cool to 50° F. to 65° F., and more preferably to about 60° F. The mass of the part dictates the time required for this step.

Immediately following the cooling step, the part is anodically electroetched for 15 to 90 minutes, after polarization occurs, in an acid solution of 300 to 425 Gm/L sulfuric acid and 350 to 450 Gm/L magnesium sulfate maintained in the range of 50° F. to 65° F. More preferably, the part is anodically electroetched for 30 to 60 minutes, after polarization occurs, in an acid solution of 350 to 375 Gm/L sulfuric acid and 380 to 420 Gm/L magnesium sulfate maintained in the range of 60 to 65° F. Current density is 50 to 150 amps/sq.ft. for this electroetching, and more preferably about 100 amps/sq.ft.

After thoroughly rinsing, the part is placed in a hot water bath and allowed to reach a uniform temperature of 100° F. to 160° F., and more preferably the same temperature as the initial temperature of the electrolytic plating bath in the following step. The time required for this step is a function of the mass of the part.

Upon reaching the referenced temperature, the part is immediately transferred into the electroplating bath and plating is initiated utilizing the bath and plating criteria according to the invention. The electrolytic plating bath from which the new, hard, electrolytic iron plating can be produced is maintained to be comprised of the following:

200–500 Gm/L ferrous sulfate;

20–70 Gm/L ferrous fluoborate;

10–35 Gm/L ammonium chloride; and an effective amount of wetting agent in an aqueous solution. According to the more preferred ranges for practicing the invention, the electrolytic plating bath from which the new, hard, electrolytic iron plating is produced is comprised of the following:

300–400 Gm/L ferrous Sulfate;

30–60 Gm/L ferrous fluoborate;

15–25 Gm/L ammonium chloride; and an effective amount of wetting agent in an aqueous solution. Finally, the electrolytic plating bath most preferably and according to the best mode has a composition consisting essentially of the following:

300–400 Gm/L ferrous sulfate;

30–60 Gm/L ferrous fluoborate;

15–25 Gm/L ammonium chloride; and 0.4–0.6 Gm/L sodium lauryl sulfate (wetting agent)

in an aqueous solution, except for minor impurities in the chemicals and water used to make up the solution and any unfiltered sludge materials that tend to accumulate over time.

It has been determined that the concentration of ammonium chloride, and more particularly the chloride anion, can have a substantial effect on the microstructure of the iron deposit. All else being equal, a higher ammonium chloride concentration tends to increase the hardness and ductility of the iron plating and to refine the grain size of the resulting iron plating, which factor can be used to help control the resulting microstructure. Thus, the concentration of the ammonium chloride in the plating bath can have an impact on creating iron plating strata having different hardness and microstructure properties.

The pH of the bath is maintained in the range of 1.5 to 4.2 and adjusted with either fluoboric acid/or sulfuric acid. More preferably, the pH of the bath is maintained in the range of 2.5 to 4 and adjusted with either fluoboric acid/or sulfuric acid. From time to time, it may be necessary to reform the electrolytic bath to obtain desired composition specifications and remove accumulated sludge materials.

The temperature of the bath is maintained at all times in the range of 100° F. to 160° F. During plating, the temperature of the bath is more preferably maintained in the range of 105° F. to 150° F. A presently most preferred initial plating temperature is about 146° F. for initially laying down a base layer of relatively dense iron. Maintaining the temperature above at least about 100° F. at all times is important to prevent precipitation of the components and maintain the quality and stability of the electrolytic plating bath, regardless of whether actual electroplating is in progress or not.

The part is cathodic and the iron-based anode is preferably pure iron or low carbon steel. Current density is relatively low and maintained in the range of 2 to 60 amps/sq.ft. More preferably, current density is maintained in the range of 5 to 45 amps/sq.ft. All current used throughout the process is D.C. in nature. According to the best mode of practicing the invention, maintaining at least a minimum current density at substantially all times is important to maintain the quality and stability of the electrolytic plating bath, regardless of whether actual electroplating is in progress or not. A dummy cathodic part can be used for this purpose when desired electroplating is not in progress.

According to a first aspect of the invention, the pH is changed within the specified pH range during the electroplating to at least partially control the microstructure of the electrodeposited iron. For example, if the pH is stepped or ramped down, the microstructure of the electrodeposited iron tends to change from a relatively dense iron plating base to an increasingly porous and channeled iron plating producing a desirable surface with a microstructure having reservoirs and channels. The pH can be stepped down, for example, at the rate of about 0.05 to about 0.15 pH units per hour. In general, it is preferred that the thicker the desired plating, the more gradual the rate of change that is applied. Furthermore, the pH can be stepped or ramped down during a particular portion of the electroplating time, instead of uniformly over the entire plating duration, which technique can further control the nature of the iron deposit layering at any particular plating thickness.

According to a second aspect of the invention, the temperature can also be changed within the specified temperature range during the electroplating to at least partially control the microstructure of the electrodeposited iron. For example, if the temperature is stepped or ramped down, the microstructure of the electrodeposited iron tends to change from a relatively dense iron plating base to an increasingly porous and channeled iron plating producing a desirable surface with a microstructure having reservoirs and channels. The temperature can be stepped down, for example, at the rate of about 3° F. /hour. In general, it is preferred that the thicker the desired plating, the more gradual the rate of change that is applied. Furthermore, the temperature can be stepped or ramped down during a particular portion of the electroplating time, instead of uniformly over the entire plating duration, which technique can further control the nature of the iron deposit layering at any particular plating thickness.

According to a third aspect of the invention, the current density is changed within the specified current density range during the electroplating to at least partially control the microstructure of the electrodeposited iron. For example, if the current density is stepped or ramped up, the microstructure of the electrodeposited iron tends to change from a relatively dense iron plating base to an increasingly porous and channeled iron plating producing a desirable surface with a microstructure having reservoirs and channels. According to the presently most preferred embodiment of the invention, the current density is increased at the rate of between 2 to 10 amps/sq.ft./hr, and more preferably at the rate of about 5 amps/sq.ft./hr. In general, it is preferred that the thicker the desired plating, the more gradual the rate of change that is applied. Furthermore, the current density can be stepped or ramped down during a particular portion of the electroplating time, instead of uniformly over the entire plating duration, which technique can further control the nature of the iron deposit layering at any plating thickness.

It has been discovered that using two or more of these inventive techniques together produces synergistic results. For example, changing the pH, temperature, and current density is especially useful in controlling the nature of the build of the iron deposit and the resulting microstructure of the iron plating.

For electroplating, the anode is preferably positioned in close proximity to the surfaces to be plated. For example, for plating the interior of a cylinder part, the anode is most preferably fixed to be positioned within the cylinder in close proximity to the inner cylindrical surfaces to be plated (but obviously not physically touching the part, which would short circuit the electrolytic plating bath). All the surfaces of the part that are to be electroplated must be placed in contact with the electrolytic plating bath, for example, by immersing the part in the bath.

According to the best mode, the anode is preferably bagged to filter and retain the sludge that accumulates from the dissolving material. Continuous filtration of the plating solution implementing a carbon type filter is imperative to maintain the integrity of the electrolytic plating bath. Agitation of the bath is mechanical and preferably kept at the minimum required to maintain a uniform composition and temperature. According to the best mode, frequent analysis of the composition of the various components of the electrolytic plating bath is a necessity in order to replenish necessary chemicals required to maintain the electrolytic plating bath specifications.

Plating time is based on the plating current density and the desired, final, finished thickness of the deposit, and preferably a minimum of about 0.005 inch additional thickness for finish honing or grinding stock. The deposition rate is approximately 0.00025 inch per hour for each multiple of 5 amps/sq.ft. of current applied.

Following electroplating, the anode is removed and the part is thoroughly rinsed with water, dewaxed, removed from its fixture, and stress relieved. Stress relief can be accomplished by either of two methods, baking or vibratory stress relief. Usually vibratory stress relief is sufficient. In addition or alternatively, the part can be stress relieved by baking the part for 3 to 8 hours at 450° F. to 750° F.

If the part has been subjected to a particularly long electroplating duration, promptly baking the part can be helpful for removing any hydrogen ions from the electrodeposited iron plating on the part, which otherwise could lead to a condition known as hydrogen embrittlement of the iron plating. Thus, according to the most preferred embodiment of the invention, the part is baked 4 to 6 hours at about 600° F. within four hours after removing the part from the plating bath. Baking the part can also increase the ductility of the iron plating.

The part is, next, honed and/or machined to the original equipment manufacturer's designed size and tolerances. At this point, the part is re-fixtured for anodically cleaning and etching in the alkaline and acid solutions, respectively, used prior to electroplating. Alkaline cleaning is done for a period of 10 to 45 minutes in the range of 50 to 150 amps/sq. ft. and electroetching occurs for 10 to 45 minutes in the range of 50 to 150 amps/sq. ft. More preferably, alkaline cleaning is done for a period of about 20 minutes at about 100 amps/sq. ft. The purpose of the later electroetching is to more vividly expose the already existing inherent network of channels or porosity of the hard iron surface.

After thoroughly rinsing and de-fixturing, the surface of the deposit is cleaned and preferably finished with a scouring material, such as a commercially available and well-known product under the trademark "SCOTCH-BRITE" marketed by the Minnesota Mining and Manufacturing Co. ("3M").

Ultimately, the part is preferably subjected to a vibratory stress relief process which eliminates any residual stress. Precise, final measurements of dimensions, porosity or channel size, as well as other pertinent areas are made and recorded; and, if all specifications are achieved, the process is complete.

Prior to the beginning of the process, all variables and/or ranges referenced above are more precisely refined. After determining, the exact conditions, all are strategically orchestrated, monitored, and meticulously maintained throughout the entire process to ultimately achieve the most desirable product for a given part and application.

EXAMPLE

A GMV Power Cylinder part made of cast iron base metal provides a working, example of the electroplating process. The weight of the cylinder part in this particular example was 1,400 pounds. The inner diameter size of the cylinder was 14.000 (+0.0020 to −0.0010) inch. The surface area of the part required 1416 square inches in plating. The cylinder had 32.1875 inch plating length and 32.3750 inch overall length. The tolerances for the part were out of round 0.0020 inch maximum and taper 0.0020 inch maximum.

The part was cleaned and physically inspected. This part has a water jacket, the integrity is of which was hydrostatically tested and any cracks repaired. The part was then honed to a minimum cleanup oversize of +0.025 inch and prepared for hard iron electroplating as generally described above by alkaline electrocleaning and acid electroetching.

The hard-iron electroplating was performed in an electroplating bath according to the most preferred and best mode of the invention as follows to build up the desired hard iron plating strata:

| Time | pH | Temperature | Current Density |
|---|---|---|---|
| 5 hrs | 3.85 | 146 F. | 5 amps/sq.ft |
| 1 hr | 3.85 | 143 | 5 |
| 1 hr | 3.85 | 140 | 5 |
| 1 hr | 3.85 | 137 | 5 |
| 1 hr | 3.70 | 134 | 5 |
| 1 hr | 3.60 | 131 | 5 |
| 1 hr | 3.50 | 128 | 5 |
| 1 hr | 3.40 | 125 | 5 |
| 1 hr | 3.30 | 122 | 5 |
| 1 hr | 3.20 | 119 | 5 |
| 1 hr | 3.10 | 116 | 5 |
| 0.5 hr | 3.05 | 113 | 10 |
| 0.5 hr | 3.00 | 110 | 15 |
| 0.5 hr | 2.95 | 110 | 20 |
| 0.5 hr | 2.90 | 110 | 25 |
| 0.5 hr | 2.85 | 110 | 30 |
| 0.5 hr | 2.80 | 110 | 35 |
| 8 hr | 2.80 | 110 | 40 |

After electroplating under these conditions, the part was then removed from the electroplating bath. Within four (4) hours after removing from the plating bath, the part was baked for four (4) hours at 600° F. The part was next honed to original equipment manufacturer's specifications, and then cleaned, etched, polished as generally described above. A final baking or vibratory stress relief step was applied to the part before final inspection of the part.

The Microstructure of the Iron Plating

Figure 2:
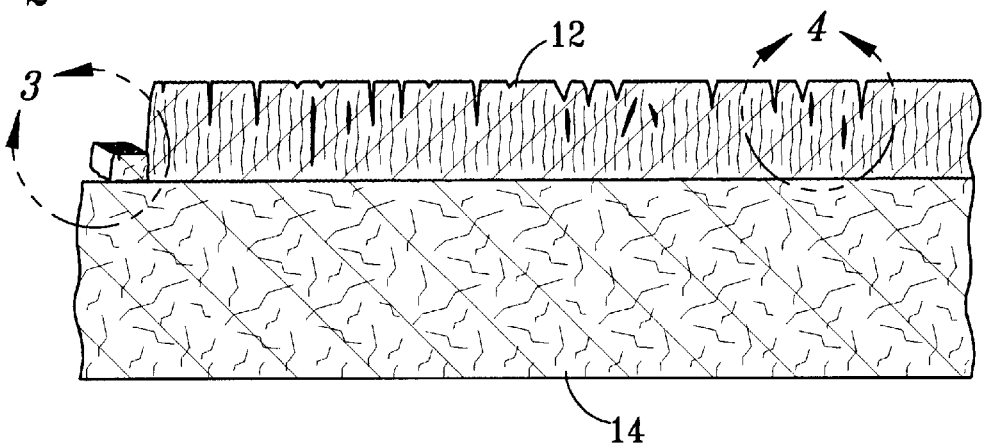
FIG. 2 is a sectional view taken along Section Line 2—2 of FIG. 1, showing the new hard iron plating produced according to the preferred embodiment of the invention.
Figure 3:
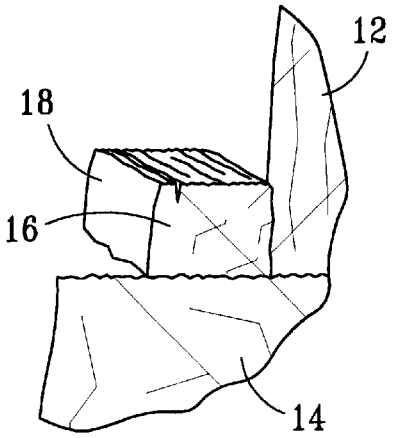
FIG. 3 is an enlarged view of a first portion of FIG. 2, which shows the results of a routine bond check, i.e., "push test" exhibiting superior bond by pulling away of base metal with electroplate.
Figure 4:
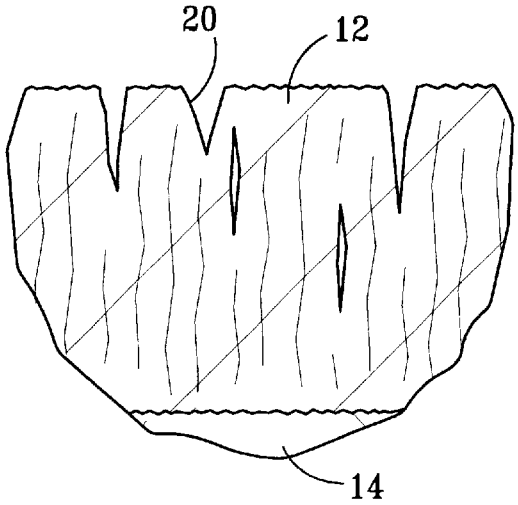
FIG. 4 is an enlarged view of a second portion of FIG. 2, which shows typical oil retaining reservoirs of the new iron surface.

In contrast to prior methods of electrodepositing iron, the present invention can produce, for example, a new hard iron with an inherent network of channel type porosity similar to that of channel type, electrolytic, industrial, hard chromium with at least one major and very significant difference. The depth of such channels in chromium are typically 0.001 inch to 0.003 inch deep, limiting its life expectancy when worn below the channel depth. In contrast, the new technique of producing hard, electrolytic, iron produces inherent channels to any desired depth. For example, channels which are in the range of 0.0005 inch to less than 0.010 inch deep are optimum for most engine part applications. Channels should not extend into the interface of the basis metal and the electrodeposit. The area or size of the plateau between the channels at the surface is variable and controllable to close tolerances specifically applicable to the ultimate application of the deposit. FIG. 1 illustrates a photomicrograph showing a typical porosity pattern of the new hard iron 12 providing an electroplate surface produced according to a preferred embodiment of the invention. FIG. 2 is a sectional view taken along Section Line 2—2 of FIG. 1, which shows the new hard iron plating 12 produced on the basis metal 14 according to the preferred embodiment of the invention. FIG. 3 is an enlarged view of a first portion of FIG. 2, which depicts the results of a routine bond check, i.e., a "push out test" exhibiting superior bond by showing a portion 16 of the basis metal 14 being visible on the bottom end of a chip 18 of the electroplate 12 after being pulled away from the basis metal 14. FIG. 4 is an enlarged view of a second portion FIG. 2, which depicts showing typical oil retaining reservoirs 20 of the new iron plating. It is to be understood, of course, the producing such surface channels maybe desirable for other part applications. It is to be understood, of course, that producing such surface channels may not be desirable for other part applications.

The process can also produce an iron deposit that is characterized by dense, fine grained, columnar microstructure, and molecularly bonded to a wide variety of basis metals. Its microstructure remarkably enables it to resist wear and coining; and, the excellent adhesion to the basis metal ensures that the basis metal will generally fail prior to any failure of the deposit. For example, the iron deposit can be controlled to offer a preplate selection of hardness ranging from 35 to 55 Rc depending on the desired application. Its tensile strength averages 235,000 psi and sheer strength exceeds 50,000 psi. Generally, the hardest portion of the deposit according to the preferred embodiments of the invention is an average of 0.008 inch thick and nearest the outer surface; but, up to at least 0.500 inch of coating may be uniformly deposited if necessary or desirable. The latter is achieved by depositing an underlay of iron of a lesser hardness so as not to create undesirable stress and weakening of the parent part.

Large, mismachined, worn or new, compressor and power cylinders and engine parts, as well as may other items are favorable candidates for the new technique. In many instances, the process actually improves the strength, durability, and/or performance of the virgin part. As a reclamation or recycling technique, this unique process permits the restoration to service of worn parts which would not have been economically, or otherwise, feasible previously.

This new and revolutionary, electrolytic, iron involves a process that is environmentally friendly since all chemicals used are either nonhazardous or can readily and easily be rendered nonhazardous. From an environmental standpoint, the process is attractive and sound. All chemicals involved in the process are readily available in the U.S.A. eliminating the dependency on foreign sources such as is the case with chromic acid used in the production of electrolytic, industrial, hard chromium. Chromic acid is, also, extremely toxic and hazardous.

CONCLUSION

The description and figures of the specific example above does not necessarily point out what an infringement would be, but are to provide at least one explanation of how to make and use the invention. Numerous modifications and variations of the preferred embodiments can be made without departing from the scope and spirit of the invention. For example, it is to be understood that some of the steps of the process can be performed in a different sequence than described above. Thus, the limits of the invention and the bounds of the patent protection are measured by and defined by the following claims:

Having described the invention, what is claimed is:

1. A process of producing an iron plating on a metal surface of a part comprising the steps of:

(a) forming and maintaining an electrolytic plating bath to comprise: 200–500 Gm/L ferrous sulfate; 20–70 Gm/L ferrous fluoborate; 10–35 Gm/L ammonium chloride; and an effective amount of wetting agent in an aqueous solution;

(b) maintaining the pH of the bath in the range of 1.5 to 4.2;

(c) maintaining the temperature of the bath in the range of 100° F. to 160° F.;

(d) maintaining the current density in the bath in the range of 2 to 60 amps/sq. ft.;

(e) contacting the metal surface of the part to be plated with the electrolytic plating bath for electroplating; and (f) changing the pH and at least one of the current density and the temperature within the specified ranges during the electroplating process to control the microstructure of different iron strata.

2. A process of producing an iron plating on a metal surface of a part according to claim 1, wherein the step of forming and maintaining an electrolytic plating bath further comprises the step of forming and maintaining the bath to comprise: 300–400 Gm/L ferrous sulfate; 30–60 Gm/L ferrous fluoborate; 15–25 Gm/L ammonium chloride; and an effective amount of wetting agent in an aqueous solution.

3. A process of producing an iron plating on a metal surface of a part according to claim 2, wherein the step of forming and maintaining an electrolytic plating bath further comprises: selecting the wetting agent from the group consisting of sodium salts of the fatty alcohol sulfates or mixtures of such salts, or any combination thereof.

4. A process of producing an iron plating on a metal surface of a pair according to claim 1, wherein the step of forming and maintaining an electrolytic plating bath further comprises the step of forming and maintaining the bath to consist essentially of: 300–400 Gm/L ferrous sulfate; 30–60 Gm/L ferrous fluoborate; 15–25 Gm/L ammonium chloride; and 0.4–0.6 Gm/L sodium lauryl sulfate in an aqueous solution.

5. A process of producing an iron plating on a metal surface of a part according to claim 1, wherein the step of maintaining the pH of the bath further comprises the step of maintaining the pH of the bath in the narrower range of 2.5 to 4.

6. A process of producing an iron plating on a metal surface of a part according to claim 1, wherein the step of maintaining the pH of the bath is accomplished by adding an effective amount of mineral acid to the bath for adjusting the pH into the specified pH range, wherein the mineral acid is selected from the group consisting of sulfuric acid, fluoboric acid, or any combination thereof.

7. A process of producing an iron plating on a metal surface of a part according to claim 1, wherein the step of changing the pH within the specified pH range further comprises the step of: decreasing the pH within the specified range during the electroplating.

8. A process of producing an iron plating on a metal surface of a part according to claim 1, wherein the step of maintaining the temperature of the bath further comprises the step of maintaining the temperature of the bath in the narrower range of 105° F. to 150° F.

9. A process of producing an iron plating on a metal surface of a part according to claim 1 further comprising the step of:

changing the temperature of the bath within the specified temperature range during the electroplating.

10. A process of producing an iron plating on a metal surface of a part according to claim 9, wherein the step of changing the temperature of the bath further comprises the step of: decreasing the temperature of the bath within the specified temperature range during the electroplating.

11. A process of producing an iron plating on a metal surface of a part according to claim 1, further comprising the steps of:

maintaining the initial temperature of the bath at about 146° F., and then, after electroplating about 0.008 inch layer of iron, reducing the temperature to about 110° F. at the rate of about 3° F. per hour.

12. A process of producing an iron plating on a metal surface of a part according to claim 1, wherein the step of maintaining the current density in the bath further comprises the step of maintaining the current density of the bath in the narrower range of 5 to 45 amps/sq.ft.

13. A process of producing an iron plating on a metal surface of a part according to claim 1, further comprising the step of changing the current density within the specified current density range.

14. A process of producing an iron plating on a metal surface of a part according to claim 1, wherein the step of changing the current density within the specified current density range comprises the step of: increasing the current density within the specified current density range, whereby a base of dense iron plating with little or no porosity is laid down, which is then changed to an iron plating having a microstructure with reservoirs and channels.

15. A process of producing an iron plating on a metal surface of a part according to claim 14, wherein the step of increasing the current density within the specified current density range is accomplished by periodically stepping up the current density.

16. A process of producing an iron plating on a metal surface of a part according to claim 15, wherein the step of increasing the current density within the specified current density range is accomplished by increasing the current density at the rate of about 2–10 amps/sq.ft./hr.

17. A process of producing an iron plating on a metal surface of a part according to claim 1, wherein the step of increasing the current density of the bath within the specified range further comprises the steps of: maintaining the initial current density of the bath at about 5 amps/sq.ft., and then after electroplating about 0.008 inch layer of iron, increasing the current density within the specified range.

18. A process of producing an iron plating on a metal surface of a part according to claim 1 further comprising the step of: vibrating the plated part to relieve stress in the part.

19. A process of producing an iron plating on a metal surface of a part according to claim 18 further comprising the step of: machining the plated part to original equipment manufacturer's specifications.

20. A process of producing an iron plating on a metal surface of a part according to claim 1 further comprising the step of: baking the plated part at least three hours at least 450° F.

21. A process of producing an iron plating on a metal surface of a part according to claim 20, wherein the step of baking the plated part is begun within four hours after electroplating the part.

22. A process of producing an iron plating on a metal surface of a part according to claim 21 further comprising the step of: machining the plated part to original equipment manufacturer's specifications.

23. A process of producing an iron plating on a metal surface of a part according to claim 21 further comprising the step of: anodically electrocleaning the plated part in an alkaline solution.

24. A process of producing an iron plating on a metal surface of a part according to claim 21 further comprising the step of: anodically electroetching the plated part in a mineral acid solution.

25. A process of producing an iron plating on a metal surface of a part comprising the steps of:

(a) forming and maintaining an electrolytic plating bath to comprise: 200–500 Gm/L ferrous sulfate; 20–70 Gm/L ferrous fluoborate; 10–35 Gm/L ammonium chloride; and an effective amount of wetting agent in an aqueous solution; (b) maintaining the pH of the bath in the range of 1.5 to 4.2;

(c) maintaining the temperature of the bath in the range of 100° F. to 160° F.;

(d) maintaining the current density in the bath in the range of 2 to 60 amps/sq.ft.;

(e) contacting the metal surface of the part to be plated with the electrolytic plating bath for electroplating; and (f) changing the pH, and at least one of the current density and the temperature parameters within the specified ranges during the electroplating of the part to control the microstructure of different iron deposit strata, such that an iron layer is deposited having little or no voids, followed by a second iron layer having a microstructure with reservoirs and channels.

26. A process of producing an iron plating on a metal surface of a part according to claim 25, wherein the step of changing comprises the step of changing the current density parameters within the specified range.

27. A process of producing an iron plating on a metal surface of a part according to claim 25, wherein the step of changing the pH, and at least one of the current density and the temperature parameters within the specified ranges further comprises the step of changing at least three of these parameters.

28. A process of producing an iron plating on a metal surface of a part according to claim 27, wherein the iron layer having little or no voids is electroplated to have a hardness which is less than that of the second iron layer having a microstructure with reservoirs and channels.

29. A process of producing an iron plating on a metal surface of a part according to claim 25, wherein the iron layer having little or no voids is electroplated to have a hardness which is less than that of the second iron layer having a microstructure with reservoirs and channels.

30. A process of producing an iron plating on a metal surface of a part according to claim 25, wherein the step of changing comprises the step of changing the temperature within the specified range.

* * * * *